US008813366B2

(12) United States Patent
Chen

(10) Patent No.: US 8,813,366 B2
(45) Date of Patent: Aug. 26, 2014

(54) FOLDING KNIFE HANDLE WITH ASSISTED OPENING FUNCTION

(76) Inventor: Chia-Ying Chen, New Taipei (TW)

( * ) Notice: Subject to any disclaimer, the term of this patent is extended or adjusted under 35 U.S.C. 154(b) by 159 days.

(21) Appl. No.: 13/537,905

(22) Filed: Jun. 29, 2012

(65) Prior Publication Data

US 2013/0291389 A1 Nov. 7, 2013

(30) Foreign Application Priority Data

May 7, 2012 (TW) ..... 101116171 A

(51) Int. Cl.
*B26B 1/04* (2006.01)

(52) U.S. Cl.
USPC ..... 30/160; 30/158; 30/161

(58) Field of Classification Search
USPC ..... 30/158, 159, 160, 161
See application file for complete search history.

(56) References Cited

U.S. PATENT DOCUMENTS 6,430,816 B2 * 8/2002 Neveux ..... 30/161
6,553,671 B2 * 4/2003 Blanchard ..... 30/161
6,732,436 B2 * 5/2004 Moizis ..... 30/155
7,121,005 B2 * 10/2006 Hughes ..... 30/158
7,275,321 B2 * 10/2007 Cheng ..... 30/160
8,161,653 B2 * 4/2012 Nenadic ..... 30/161
8,375,589 B2 * 2/2013 Bremer et al. ..... 30/155
2004/0244205 A1 * 12/2004 Linn et al. ..... 30/159
2007/0151110 A1 * 7/2007 Chen ..... 30/155
2009/0211102 A1 * 8/2009 Chen ..... 30/161
2011/0067246 A1 * 3/2011 Perez ..... 30/158
2013/0133205 A1 * 5/2013 Lo ..... 30/160
2013/0291389 A1 * 11/2013 Chen ..... 30/160

* cited by examiner

*Primary Examiner* — Hwei C Payer
(74) *Attorney, Agent, or Firm* — Bacon & Thomas, PLLC

(57) ABSTRACT

The present invention relates to a folding knife handle, which includes a first housing pivotally connected to a blade and formed with an arcuate guide groove through which a stud of the blade passes, a pushing element movably located on the first housing and having one end exposed from the handle, a pressing element connected to the pushing element and having one end provided with a pressing plate, and a second housing assembled to the first housing to cover the pressing element. When the stud is located at a first end of the arcuate guide groove and the pressing plate doesn't press against the stud, the blade is fully received in the handle and, when the pressing plate presses against and moves the stud toward a second end of the arcuate guide groove, the stud is driven by a resilient member to move the blade fully out of the handle.

8 Claims, 9 Drawing Sheets

FOLDING KNIFE HANDLE WITH ASSISTED OPENING FUNCTION

FIELD OF THE INVENTION

The present invention relates to a folding knife handle, more particularly to a folding knife handle having a pushing element and a pressing element for allowing a user to use the pushing element to release a blade from the handle and, in the meanwhile, enabling the pressing element to rotate the blade out of the handle.

BACKGROUND OF THE INVENTION

Nowadays, the market is supplied with a variety of folding knives. As is well known, a folding knife uses a resilient plate to assist in driving out the blade. Referring to FIGS. 1A and 1B, the folding knife 1 includes a blade 11, a handle 13, and a resilient plate 15. The blade 11 has one end pivotally connected to a first end of the handle 13 so that the blade 11 can rotate about the pivotally connected position either into or out of the handle 13. A stud, or pushing post, 111 is provided on the blade 11, adjacent to the aforesaid end thereof, and located outside the handle 13. The resilient plate 15 has a first end positioned near the other end (hereinafter, the second end) of the handle 13 and a second end extending to a position adjacent to where the handle 13 and the blade 11 are pivotally connected. When the blade 11 is completely received in the handle 13, the resilient plate 15 presses against the aforesaid end of the blade 11. More particularly, the portion of the resilient plate 15 that presses against the blade 11 applies a first force A thereto (as indicated by the dashed-line arrow A in FIG. 1A), and the first force A tends to rotate the blade 11 further into the handle 13. Consequently, the blade 11 is firmly positioned in the handle 13. Once the blade 11 is rotated out of the handle 13 by a predetermined angle (about 4 to 8 degrees), the resilient plate 15 applies a second force B to the blade 11 (as indicated by the dashed-line arrow B in FIG. 1B), causing further rotation of the blade 11 out of the handle 13. As a result, the blade 11 spins instantaneously and completely out of the handle 13.

As shown in FIGS. 1A and 1B, the resilient plate 15 can press against different parts of the blade 11 and apply different forces thereto to either hold the blade 11 securely in the handle 13 or speed up rotation of the blade 11 out of the handle 13. Therefore, when it is desired to rotate the blade 11 from inside the handle 13 to the outside, the user only has to push the pushing post 111 with a thumb, thereby rotating the blade 11 out of the handle 13 by the predetermined angle (about 4 to 8 degrees), and the blade 11 will rotate instantly and completely out of the handle 13 in away similar to a switchblade.

Apart from the aforesaid design, it is feasible to replace the resilient plate with a spiral spring as the element that assists in pushing the blade, and this replacement is demonstrated in FIG. 2, in which most of the elements are identical to those in FIGS. 1A and 1B and are therefore identified by the same reference numerals as in FIGS. 1A and 1B. The spiral spring 21 in FIG. 2 is provided where the blade 11 is pivotally connected to the handle 13. The spiral spring 21 constantly applies to the blade 11 a force that tends to rotate the blade 11 out of the handle 13. When the blade 11 is completely received in the handle 13, a detent unit (not shown) on the handle 13 holds the blade 11 and applies another force thereto such that the blade 11 is positioned in the handle 13. To rotate the blade 11 out of the handle 13, the user only has to push the pushing post 111 on the blade 11 to overcome the force applied by the detent unit and disengage the blade 11 from the detent unit, and the blade 11 will rotate rapidly out of the handle 13 due to the force applied by the spiral spring 21 to the blade 11.

Referring again to FIGS. 1A to 2, while the folding knife 1 may use either the resilient plate 15 or the spiral spring 21 to push the blade 11, a user cannot rotate the blade 11 out of the handle 13 without applying a force to the pushing post 111. Hence, even if the folding knife 1 is carried by the user in a pocket and subjected to impact while the user is walking or doing exercise, the blade 11 will not spin out. After all, the folding knife 1 is so configured that unless the pushing post 111 is pushed to rotate the blade 11 out of the handle 13 by the predetermined angle (about 4 to 8 deuces) or unless the blade 11 is disengaged from the detent unit on the handle 13, the blade 11 cannot pop out of the handle 13, and this is the major difference between the folding knife 1 undo switchblade, whose blade will spring out as soon as a button is touched or pressed. Nevertheless, the inventor of this patent application has found the following drawbacks of the folding knife 1 in use. First of all, the pushing post 111, which a user must push with a thumb to drive the blade 11 into rotation, only has a limited length; therefore, the top end of the pushing post 111 is pretty close to the outer surface of the handle 13, making it difficult for the user to push the pushing post 111 and open the knife with a single hand. This is especially true of one who has never used the folding knife 1 before. Thus, the convenience of the folding knife 1 is seriously compromised. Furthermore, given the limited length of the pushing post 111, the user's thumb must be very close to one lateral surface of the blade 11 while pushing the pushing post 111. Also, as the blade 11 spins rapidly out of the handle 13, the user's thumb is within the rotation range of the blade 11. Such close proximity of the thumb to the blade 11 may result in cutting injury and create a sense of fear in those who are using the folding knife 1.

With the conventional folding knives still having problems in use, the issue to be addressed by the present invention is to overcome the aforesaid shortcomings of the prior art, provide greater convenience of use, and effectively eliminate the risk of injury during use.

BRIEF SUMMARY OF THE INVENTION

In view of the fact that the conventional folding knives cannot fully satisfy users' needs, the inventor of the present invention conducted extensive research and experiment and finally succeeded in developing a folding knife handle with an assisted opening function. It is hoped that the present invention can provide the general public with a more convenient and safer folding knife.

It is an object of the present invention to provide a folding knife handle having an assisted opening function, wherein the handle includes a first housing, a pushing element, a pressing element, and a second housing. The first housing has a first end pivotally connected to one end of a blade. In addition, the first housing is formed with an arcuate guide groove through which a stud of the blade passes and in which the stud can move. The stud is located at a first end of the arcuate guide groove when the blade is received in the handle, and at a second end of the arcuate guide groove when the blade is fully exposed from the handle. The first housing is further formed with at least one slot adjacent to one edge of the first housing. The pushing element and the pressing element are located on two opposite lateral surfaces of the first housing respectively and are connected to each other. The pushing element has one end exposed from the first housing. A sliding post is protrudingly provided on the pushing element, passes through one of the at least one slot, and can be moved therein. The pressing element has one end provided with a pressing plate. When the stud is located at the first end of the arcuate guide groove and the sliding post is pressed against a first end of the slot, the pressing plate stays out of contact with the stud. When the sliding post is moved toward a second end of the slot, the pressing plate presses against the stud and moves the stud toward the second end of the arcuate guide groove until the blade is driven by a resilient member to move the stud to the second end of the arcuate guide groove. The second housing is assembled to the first housing to cover the pressing element. To use the folding knife, the user only has to move an index finger and push the pushing element away from where the blade is pivotally connected to the handle, and the blade will rotate out of the handle under the action of the pressing element. This allows the folding knife to be used more safely and more conveniently than its prior art counterparts.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1A:
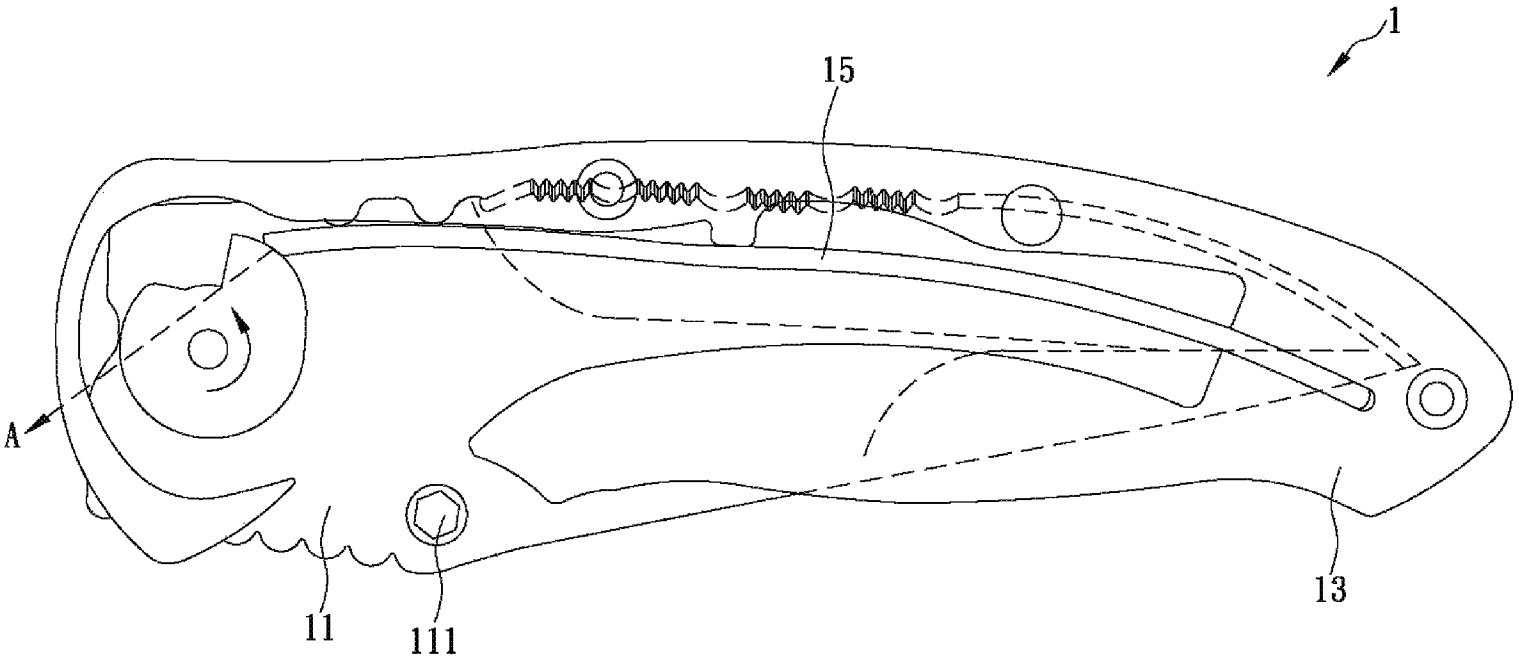
FIG. 1A(Prior Art)
FIG. 1A schematically shows a first state of a conventional folding knife.
Figure 1B:
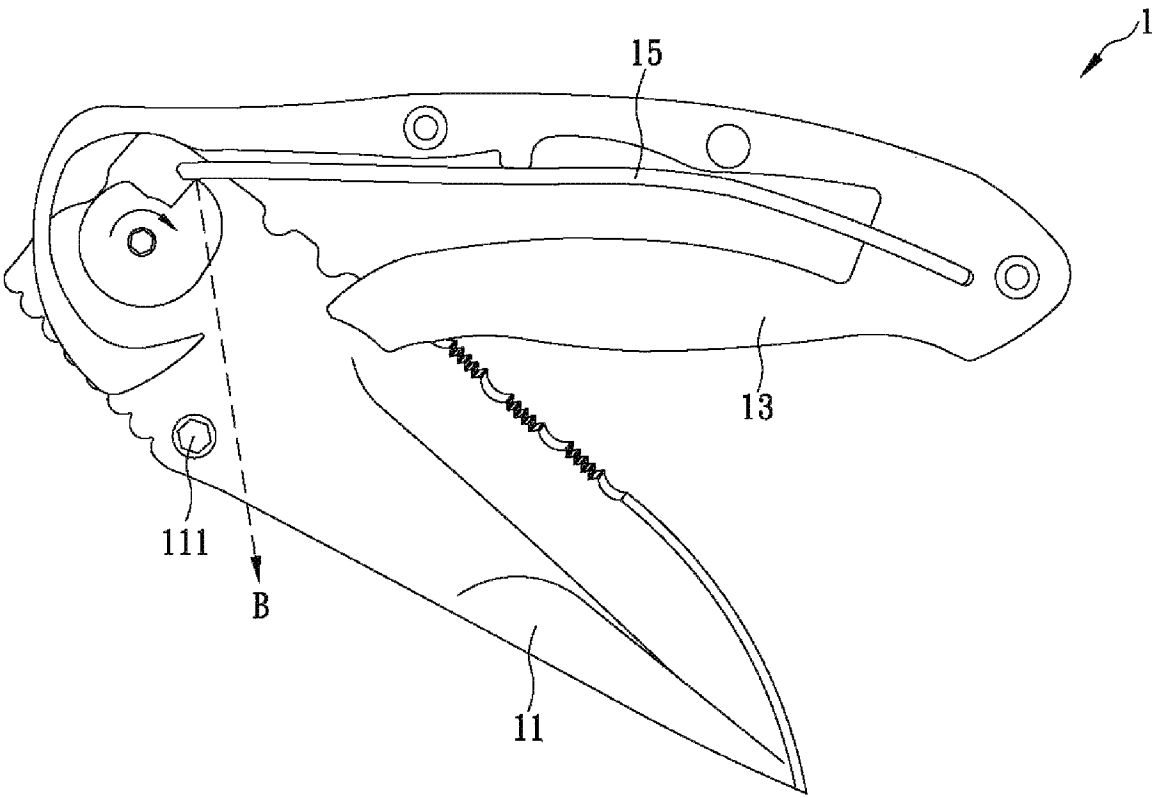
FIG. 1B(Prior Art)
FIG. 1B schematically shows a second state of the conventional folding knife depicted in FIG. 1A.
Figure 2:
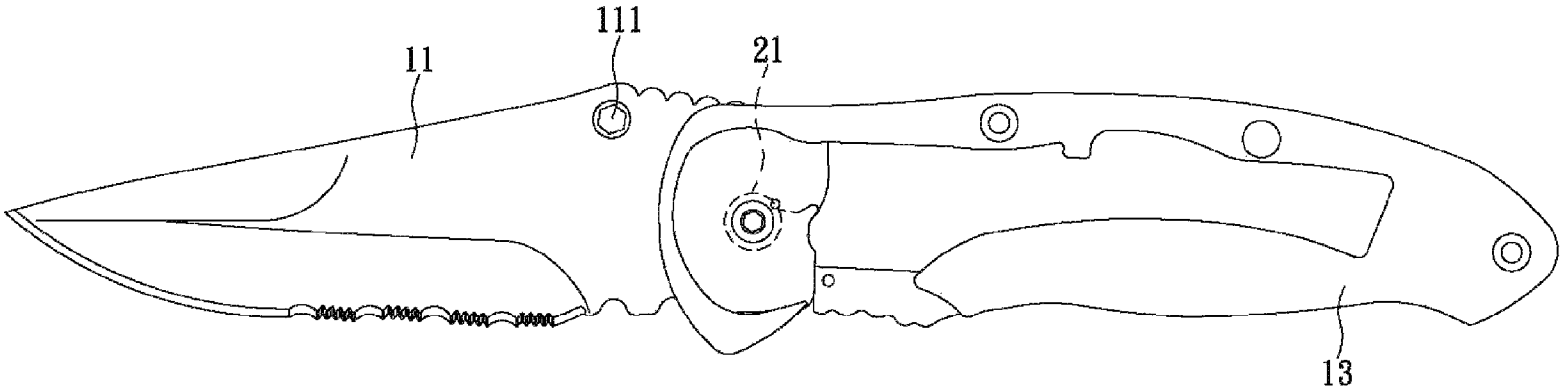
FIG. 2(Prior Art)
FIG. 2 schematically shows another conventional folding knife.
Figure 3:
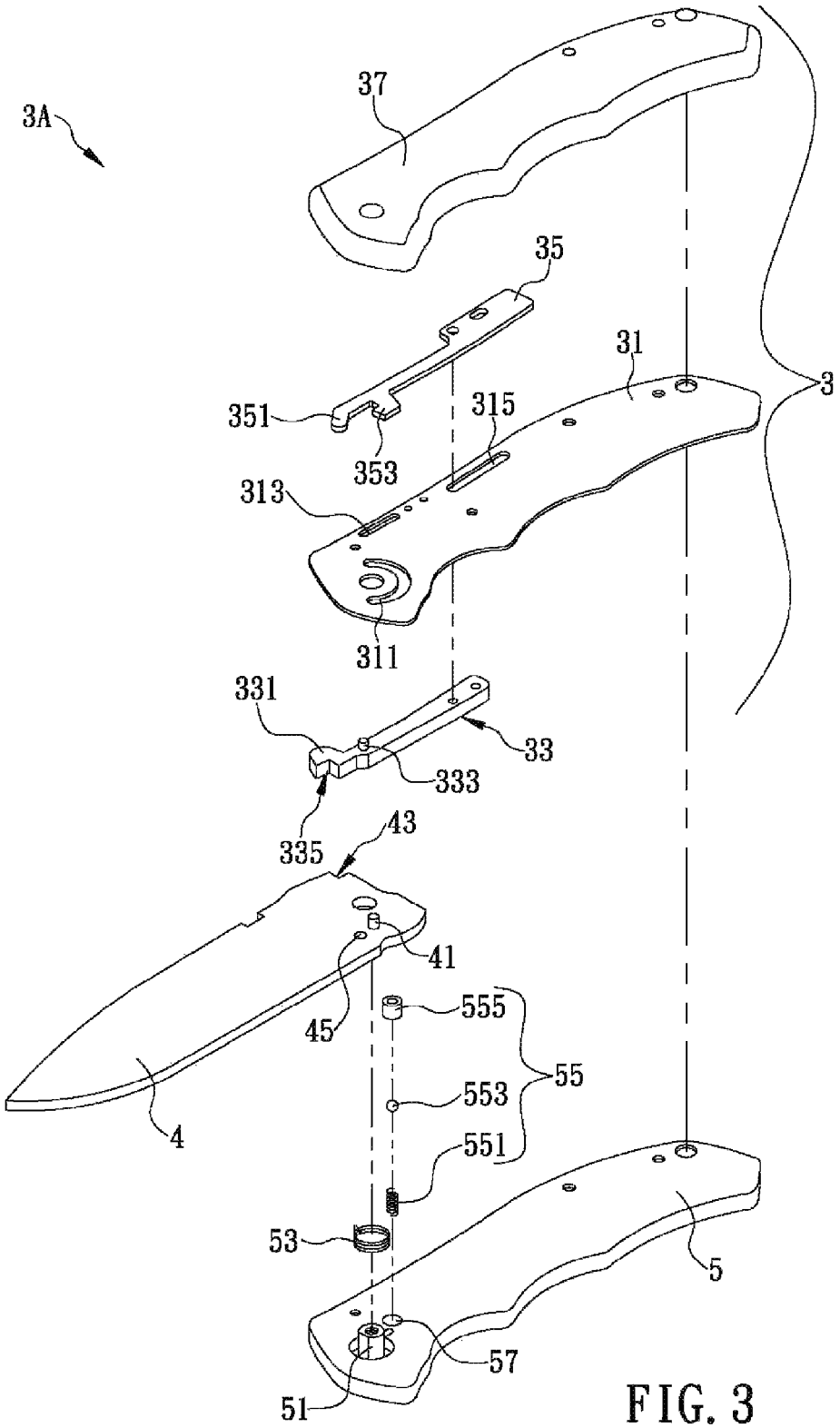
FIG. 3 is an exploded perspective view of a folding knife according to the present invention.

The present invention discloses a folding knife handle with an assisted opening function. To facilitate description, a folding knife 3A is shown in FIG. 3 in an exploded perspective view. The folding knife 3A includes a first handle half 3, a blade 4, and a second handle half 5, wherein the first handle half 3 demonstrates the structure of the disclosed folding knife handle with an assisted opening function. As shown in FIG. 3, the first handle half 3 includes a first housing 31, a pushing element 33, a pressing element 35, and a second housing 37. The first housing 31 has a first end pivotally connected to one end of the blade 4 (hereinafter referred to as the end of the blade 4), thus allowing the blade 4 to rotate either toward or away from the first housing 31. Additionally, an arcuate guide groove 311 is formed at the first end of the first housing 31, and the first housing 31 further has at least one slot adjacent to one edge of the first housing 31 opposite to the position that the blade 4 can be rotated out of the handle. In this embodiment, the at least one slot is implemented by a first slot 313 and a second slot 315, both formed as elongate holes that penetrate the housing 31. The first slot 313 has a first end adjacent to the first end of the first housing 31 and a second end extending toward a second end of the first housing 31. The second slot 315 has a first end adjacent to the second end of the first slot 313 and a second end also extending toward the second end of the first housing 31.

As shown in FIG. 3, the blade 4 is provided with a stud 41 adjacent to where the blade 4 is connected to the first housing 31. The stud 41 passes through the arcuate guide groove 311 and can be moved therein. When the blade 4 is completely received in the first housing 31, the stud 41 is located at a first end of the arcuate guide groove 311 (see FIG. 4A). In the course where the blade 4 is rotated out of the first housing 31, the stud 41 is moved from the first end toward a second end of the arcuate guide groove 311. Once the blade 4 is fully exposed from the first housing 31, the stud 41 is located at the second end of the arcuate guide groove 311 (see FIG. 5A). The pushing element 33 is located on one lateral surface of the first housing 31 and has a first end exposed from the first housing 31 and forming a pushing portion 331 which a user can push with a finger. Also, the pushing element 33 is protrudingly provided with a sliding post 333 adjacent to the first end of the pushing element 33. The sliding post 333 passes through the first slot 313 and can be moved therein while a second end of the pushing element 33 corresponds in position to the second slot 315. In a different embodiment of the present invention in which the first housing 31 has only one slot (e.g., one that includes the first slot 31) and the second slot 315 connected together), however, the sliding post 333 and the second end of the pushing element 33 correspond in position to the same slot.

Figure 4A:
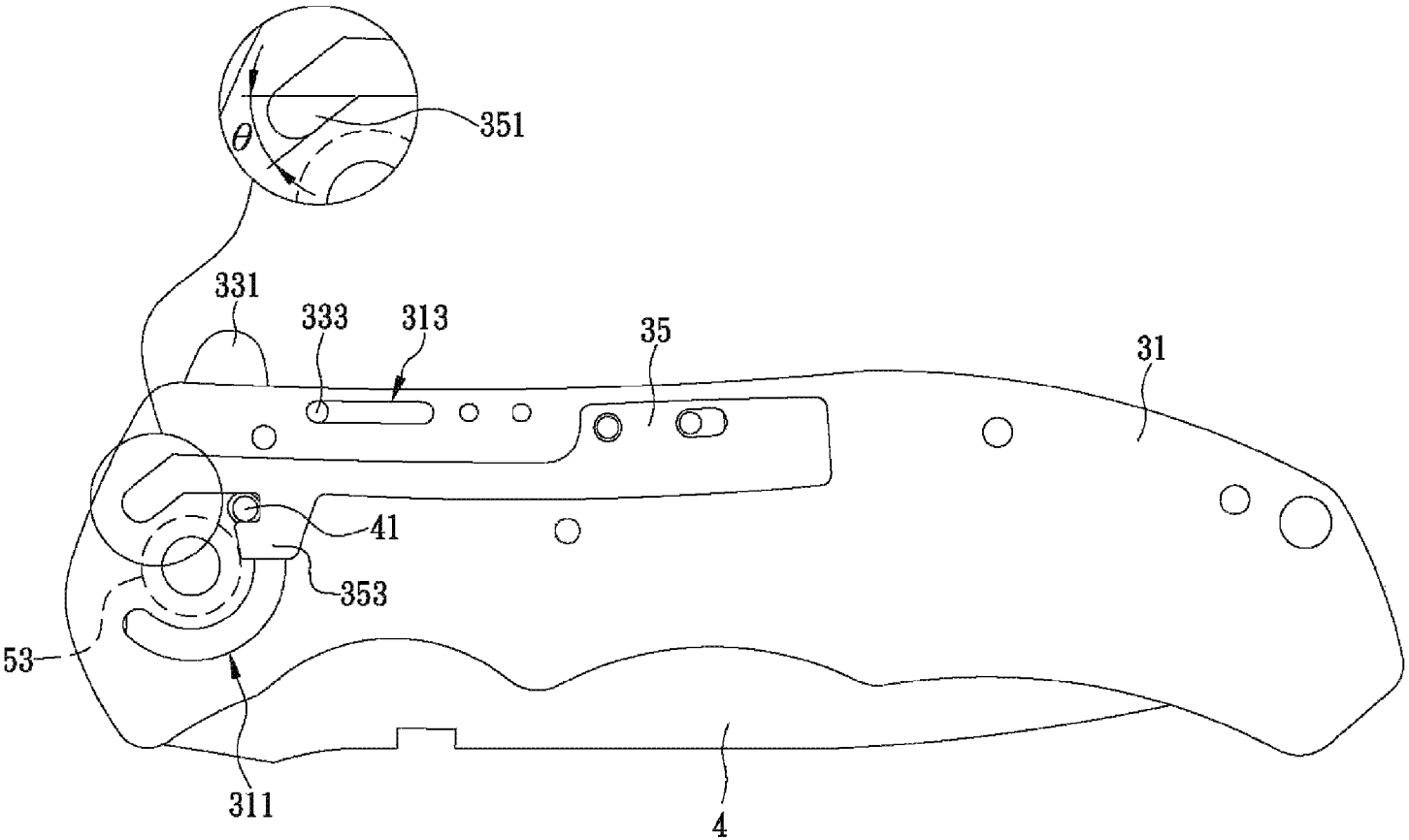
FIG. 4A schematically shows a first state in which a blade is received in a handle according to the present invention.
Figure 4B:
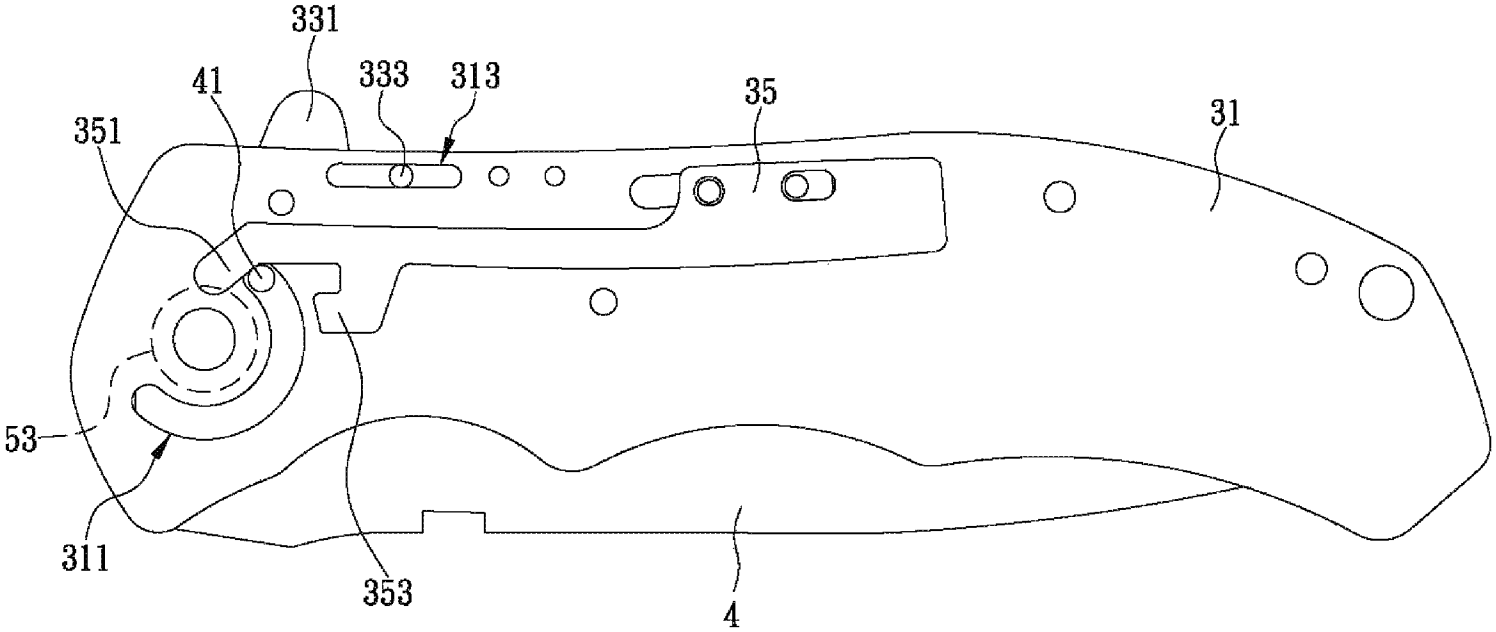
FIG. 4B schematically shows a second state in which the blade depicted in FIG. 4A is received in the handle of the present invention.

Referring to FIGS. 3 and 4A, the pressing element 35 is located, on the opposite (hereinafter the second) lateral surface of the first housing 31. The pressing element 35 has a first end extended with a pressing plate 351, wherein the pressing plate 351 forms an angle θ (e.g., 30 to 50 degrees) with the pressing element 35. The pressing element 35 is further extended with a locking plate 353 adjacent to the first end of the pressing element 35. The pressing element 35 also has a second end which corresponds in position to the second end of the pushing element 33 and which is connected to the second end of the pushing element 33 through the second slot 315 so that the pressing element 35 can be driven by the pushing element 33. However, in a different embodiment of the present invention in which the first housing 31 has only one slot, the second end of the pressing element 35 corresponds in position to this very slot and is connected to the second end of the pushing element 33 through the slot so as to be driven by the pushing element 33. When the blade 4 is received in the first housing 31 and the stud 41 is located at the first end of the arcuate guide groove 311, the user can push the pushing portion 331 with a finger so that the sliding post 333 is pressed against the first end of the first slot 313. By doing so, the pressing plate 351 is moved toward the first end of the first housing 31 and kept from contact with the stud 41. At the meantime, the locking plate 353 is moved to a position corresponding to the arcuate guide groove 311. Consequently, the stud 41 is located in a gap between the locking plate 353 and the first end of the arcuate guide groove 311 and is prevented from moving toward the second end of the arcuate guide groove 311. Referring to FIG. 4B, when the user pushes the pushing portion 331 again such that the sliding post 333 is moved toward the second end of the first slot 313, both the pressing plate 351 and the locking plate 353 are moved toward the second end of the first housing 31. As a result, the locking plate 353 is moved away from the arcuate guide groove 311, and the pressing plate 351 is pressed against the stud 41 and pushes the stud 41 toward the second end of the arcuate guide groove 311.

Figure 5A:
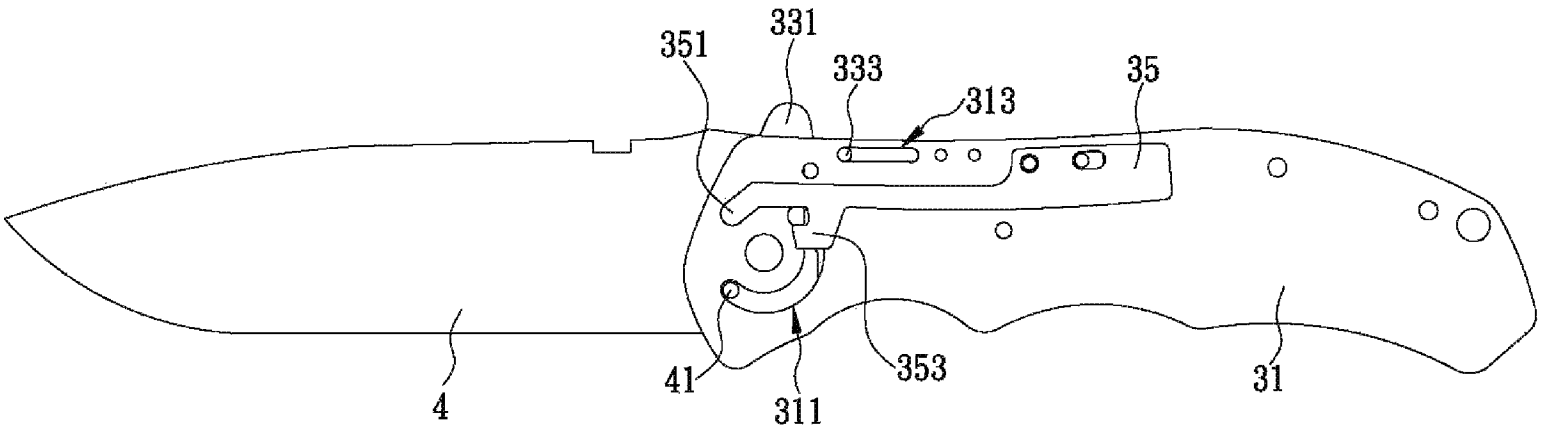
FIG. 5A is a side view in which the blade depicted in FIG. 4A has spun out.
Figure 5B:
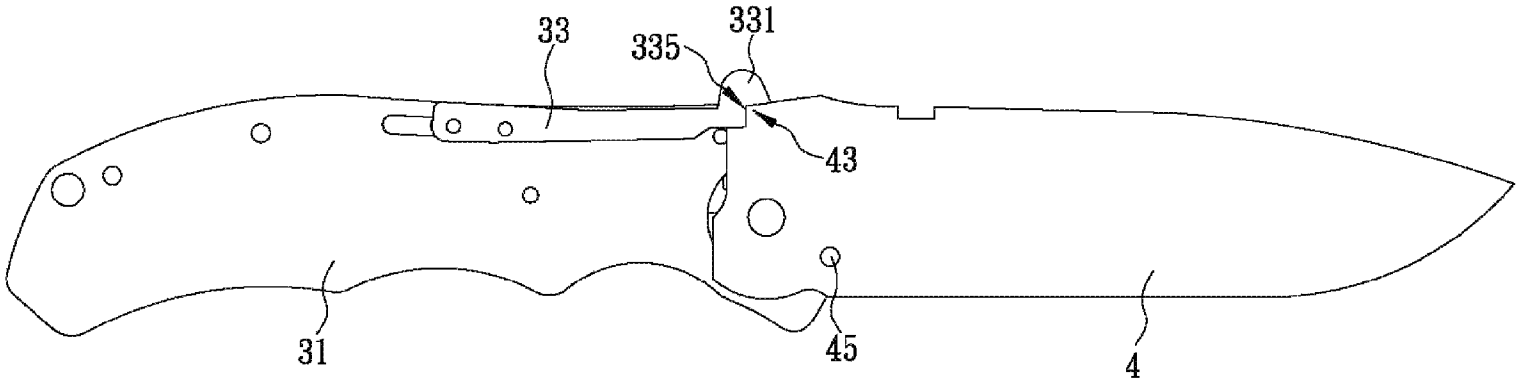
FIG. 5B is another side view in which the blade depicted in FIG. 4A has spun out.

Reference is now made to FIGS. 3, 5A, and 5B. Once the blade 4 has been rotated completely out of the first housing 31 and the stud 41 has been moved to the second end of the arcuate guide groove 311, the user can push the pushing portion 331, or an additionally provided restoring spring (not shown) can be activated to push at the second end of the pressing element 35, as a way to move the sliding post 333 to the first end of the first slot 313. By doing so, a first positioning portion 335 which is formed at the first end of the pushing element 33 and which corresponds in position to the pushing portion 331 is pressed against a second positioning portion 43 formed at the end of the blade 4. Thus, the blade 4 is restricted by the pushing element 33 and can pivot no more. In other words, the blade 4 will be securely positioned outside the first handle half 3 and the second handle half 5 and will not suddenly rotate while the folding knife 3A is in use. The safety of use of the folding knife 3A is thereby substantially enhanced.

Figure 6:
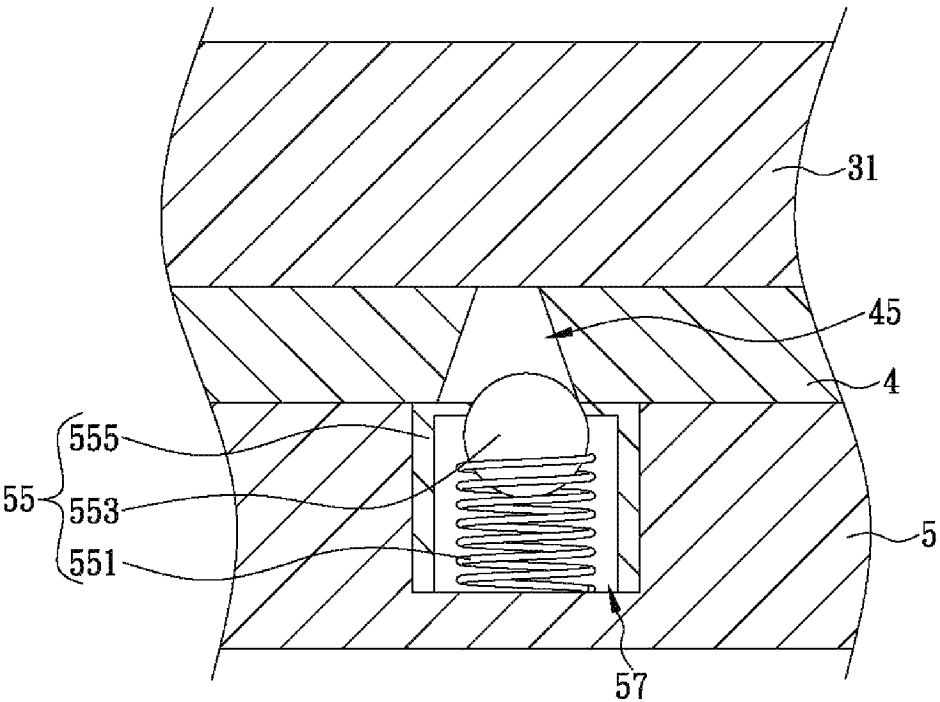
FIG. 6 is a sectional view of a detent unit according to the present invention.

Referring again to FIG. 3, the second housing 37 is assembled to the second lateral surface of the first housing 31 to cover the pressing element 35 and give the first handle half 3 a neat look. The second handle half 5, on the other hand, has one end provided with a pivot post 51. The pivot post 51 passes sequentially through the end of the blade 4 and the first end of the first housing 31 and is fixed to the second housing 37 such that the blade 4 is pivotally connected to the second handle half 5. A resilient member 53 is provided between the pivot post 51 and the blade 4. The resilient member 53 in this embodiment is a spiral spring for applying to the blade 4 a force that tends to rotate the blade 4 out of the handle halves 3 and 5. In addition, a detent unit 55 is provided on the second handle half 5. The detent unit 55 includes a compression spring 551, an engaging element 553 (e.g., a steel ball), and a sleeve 555. Referring to FIGS. 3 and 6, the detent unit 55 is received in a cavity 57 of the second handle half 5, and both the engaging element 553 and the compression spring 551 are provided in the sleeve 555. With the two ends of the compressing spring 551 pressing against the second handle half 5 and the bottom of the engaging element 553 respectively, the top of the engaging element 553 tends to jut out of the top surface of the sleeve 555. When the blade 4 is completely received in the handle halves 3 and 5, an engaging hole 45 on the blade 4 corresponds in position to the detent unit 55; consequently, the top of the engaging element 553 is exposed from the sleeve 555 and presses against the sidewall of the engaging hole 45. As the force applied by the compressing spring 551 to the engaging element 553 is greater than the outwardly rotating force applied by the resilient element 53 to the blade 4, the blade 4 is positioned in, and kept from rotating out of, the handle halves 3 and 5.

Referring to FIGS. 3 to 6, it can be known from the above that, when the blade 4 is received in the handle halves 3 and 5 (i.e., the first housing 31), not only does the locking plate 353 of the pressing element 35 confine the stud 41 at the first end of the arcuate guide groove 311 (see FIG. 4A), but also the detent unit 55 secures the blade 4 in place. The blade 4 is thus firmly positioned in the handle halves 3 and 5 and will not be rotated out of the handle halves 3 and 5 by inadvertent collision while the folding knife 3A is in the folded state. When it is desired to use the folding knife 3A, the pushing portion 331 is pushed first, so as for the locking plate 353 of the pressing element 35 to move away from the position where it corresponds to the arcuate guide groove 311. At the same time, the pressing plate 351 is pressed against the stud 41 (see FIG. 4B) and applies a force thereto to drive the stud 41 toward the second end of the arcuate guide groove 311. Once the force applied by the pressing plate 351 to the stud 41 is sufficient to overcome the force of the compression spring 551, the engaging element 553 is pushed into the sleeve 555 and no longer pressed against the sidewall of the cavity 45. This allows the resilient member 53 (as indicated by the dashed-line circle in FIG. 4B) to drive the blade 4 into rotation out of the handle halves 3 and 5. After the blade 4 spins out, the pushing portion 331 can be pushed again to bring the first positioning portion 335 into engagement with the second positioning portion 43, thereby preventing the blade 4 from rotation during use. In short, to rotate the blade 4 out of its received position in the handle halves 3 and 5, the user only has to push the pushing portion 33, which is outside the rotation range of the blade 4, away from where the blade 4 is pivotally connected to the handle halves 3 and 5, and the blade 4 will spin out of the handle halves 3 and 5. The assisted opening mechanism described above significantly increases the user's safety in opening the folding knife 3A.

In embodiments other than those disclosed above, the conventional resilient plate can also be used to assist in pushing the blade. For instance, when the stud is at the first end of the arcuate guide groove, the resilient plate applies a force to the blade that tends to rotate the blade further into the handle, and when the stud has been pushed by the pressing plate and moved a certain distance, the resilient plate applies another force to the blade to rotate it out of the handle. As the use of the resilient plate is well known in the art, and the present invention is directed mainly to a folding knife handle that provides assisted opening, the structure of a folding knife having the aforesaid resilient plate will not be further described herein. A person skilled in the art who has fully understood the technical features of the present invention shall be able to apply the present invention to folding knives where a resilient plate is used. Moreover, since the blade can be fixed in position by one or more detent units, such features as the locking plate or the first positioning portion can be dispensed with to simplify the manufacturing process. Or, the sliding post may be located in the second slot while the portion connecting the pushing element and the pressing element corresponds in position to the first slot. The folding knife handle with an assisted opening function the first handle half) as disclosed by the present invention is in fact applicable to various types of folding knives so as to meet users' needs and effectively increase the manufacturers' market competitiveness.

While the invention herein disclosed has been described by means of specific embodiments, numerous modifications and variations could be made thereto by those skilled in the art without departing from the scope of the invention set forth in the claims.

What is claimed is:

1. A folding knife with an assisted opening function, comprising:

a blade;

a first housing having a first end pivotally connected to an end of the blade, the first housing being formed with an arcuate guide groove and at least one slot, the arcuate guide groove being passed through by a stud of the blade, wherein the stud is located at a first end of the arcuate guide groove when the blade is received in the first housing, and is located at a second end of the arcuate guide groove when the blade is fully exposed from the first housing, the at least one slot being adjacent to an edge of the first housing opposite to the position that the blade can be rotated out of the first housing, the at least one slot comprising a first slot, and the first slot having a first end extending toward the first end of the first housing and a second end extending toward a second end of the first housing;

a pushing element located on a first lateral surface of the first housing, the pushing element having an end exposed from the first housing to form a pushing portion, the pushing element being protrudingly provided with a sliding post, the sliding post passing through and being movable in the first slot;

a pressing element located on a second lateral surface of the first housing and connected to the pushing element so as to be driven by the pushing element, the pressing element having an end extended with a pressing plate, the pressing plate forming an angle with the pressing element, wherein when the stud is located at the first end of the arcuate guide groove and the sliding post is pressed against the first end of the first slot, the pressing plate is not in contact with the stud, and when the sliding post is moved toward the second end of the first slot, the pressing plate presses against the stud and pushes the stud toward the second end of the arcuate guide groove until the blade is driven by a resilient member to move the stud to the second end of the arcuate guide groove; and a second housing assembled to the second lateral surface of the first housing to cover the pressing element.

2. The folding knife of claim 1, wherein the pressing element is further provided with a locking plate adjacent to the end of the pressing element, and when the sliding post is pressed against the first end of the first slot, the locking plate is located at a position corresponding to such that the stud is received in a gap between the locking plate and the first end of the arcuate guide groove.

3. The folding knife of claim 2, wherein the end of the pushing element is further provided with a first positioning portion corresponding in position to the pushing portion, and the first positioning portion can be pressed against a second positioning portion to prevent the blade from rotating into the first housing, the second positioning portion being formed at the end of the blade.

4. The folding knife of claim 3, wherein the at least one slot comprises a second slot having a first end adjacent to the second end of the first slot and a second end extending toward the second end of the first housing, and the pushing element is connected to the pressing element through the second slot.

5. The folding knife of claim 4, wherein the angle is between 30 and 50 degrees.

6. The folding knife of claim 1, wherein the end of the pushing element is further provided with a first positioning portion corresponding in position to the pushing portion, and the first positioning portion can be pressed against a second positioning portion to prevent the blade from rotating into the first housing, the second positioning portion being formed at the end of the blade.

7. The folding knife of claim 6, wherein the at least one slot comprises a second slot having a first end adjacent to the second end of the first slot and a second end extending toward the second end of the first housing, and the pushing element is connected to the pressing element through the second slot.

8. The folding knife of claim 7, wherein the angle is between 30 and 50 degrees.

* * * * *